US008766129B2

(12) United States Patent
Kazakov et al.

(10) Patent No.: US 8,766,129 B2
(45) Date of Patent: Jul. 1, 2014

(54) METHOD FOR SEPARATING MINERALS WITH THE AID OF X-RAY LUMINESCENCE

(75) Inventors: Leonid Vasilievich Kazakov, Saint-Petersburg (RU); Natalia Pavlovna Kolosova, Saint-Petersburg (RU)

(73) Assignee: Research and Production Enterprise "Bourevestnik", St. Petersburg (RU)

( * ) Notice: Subject to any disclaimer, the term of this patent is extended or adjusted under 35 U.S.C. 154(b) by 0 days.

(21) Appl. No.: 13/637,191

(22) PCT Filed: Nov. 8, 2011

(86) PCT No.: PCT/RU2011/000874
§ 371 (c)(1),
(2), (4) Date: Sep. 25, 2012

(87) PCT Pub. No.: WO2012/067541
PCT Pub. Date: May 24, 2012

(65) Prior Publication Data

US 2013/0220898 A1 Aug. 29, 2013

(30) Foreign Application Priority Data

Nov. 19, 2010 (RU) ..... 2010148486

(51) Int. Cl.
*B07C 5/346* (2006.01)

(52) U.S. Cl.
USPC ..... 209/589; 378/45

(58) Field of Classification Search
USPC ..... 209/44.2, 576, 577, 580–582, 589, 639; 378/45
See application file for complete search history.

(56) References Cited

U.S. PATENT DOCUMENTS 4,848,590 A * 7/1989 Kelly ..... 209/564
6,421,415 B1 * 7/2002 Peczkis et al. ..... 378/46

(Continued)

FOREIGN PATENT DOCUMENTS

EP 0552819 7/1993
GB 2022824 A 12/1979

(Continued)

OTHER PUBLICATIONS

All office actions including decision to grant for RU application which forms basis of PPH request and English translations thereof.

(Continued)

*Primary Examiner* — Joseph C Rodriguez
*Assistant Examiner* — Kalyanavenkateshware Kumar
(74) *Attorney, Agent, or Firm* — Garcia-Zamor IP Law; Ruy M. Garcia-Zamor

(57) ABSTRACT

The method relates to the field of mineral enrichment. It involves setting a threshold value for the intensity of a luminescence signal after a given time following the end of a pulse of exciting radiation, measuring, in the course of registering the intensity of the luminescence signal of a mineral, the intensity of the luminescence signal after a given time following each pulse of exciting radiation, recording the intensity value obtained for each luminescence signal if the signal registered exceeds the set threshold value, comparing the value measured in the current period with the values obtained in the preceding periods, determining the period in which the intensity value was at its peak, and processing the luminescence signal in which the value of the measured intensity was at its peak in order to determine the separation parameters; a decision to separate the mineral to be enriched is taken in the event that the separation parameters are inside the range of given values.

3 Claims, 2 Drawing Sheets

(56) References Cited

U.S. PATENT DOCUMENTS

| | | | | |
|---|---|---|---|---|
| 7,763,820 | B1 * | 7/2010 | Sommer et al. | 209/589 |
| 2009/0261024 | A1 * | 10/2009 | Sommer et al. | 209/589 |

FOREIGN PATENT DOCUMENTS

| | | |
|---|---|---|
| GB | 2310927 A | 9/1997 |
| RU | 1459014 | 9/1995 |
| RU | 2196013 | 1/2003 |
| RU | 2235599 | 9/2004 |
| RU | 2236914 | 9/2004 |
| RU | 2249490 | 4/2005 |
| RU | 2355483 | 5/2009 |
| RU | 2356651 | 5/2009 |
| RU | 2362635 | 7/2009 |
| SU | 1510185 | 8/1995 |

OTHER PUBLICATIONS

Translation of Russian Written Opinion; Russian Written Opinion; and Russian International Search Report for PCT/RU2011/000874. Publication for PCT/RU2011/000874.

* cited by examiner

METHOD FOR SEPARATING MINERALS WITH THE AID OF X-RAY LUMINESCENCE

CROSS REFERENCE TO RELATED APPLICATIONS

This application claims priority to the following patent applications: (1) Patent Cooperation Treaty Application PCT/RU2011/000874 filed Nov. 8, 2011; and (2) Russian Application No. 2010148486 filed Nov. 19, 2010; each of the above cited applications is hereby incorporated by reference herein as if fully set forth in its entirety.

FIELD OF TECHNOLOGY

This invention belongs to the field of mineral dressing, and, more particularly, to methods for the segregation of crushed mineral matter containing minerals that become fluorescent under the effect of excitation radiation into concentrating product and tailings. The proposed method can be implemented on X-ray fluorescent separators with pulse action of fluorescence excitation to be used at different beneficiation stages.

PRIOR ART

The mineral fluorescence signal recorded for some time is characterized by the intensity variation trend in time (kinetic characteristics) and can be considered as the superposition or overlapping of two components: a short-lived or fast component (further—FC) that occurs virtually simultaneously (at several microseconds interval) with the start of the excitation radiation effect and disappears immediately after end of that effect; and long-lived or slow fluorescent component (further—SC) the intensity of which continuously increases during excitation radiation effect and decays relatively slowly (between hundreds of microseconds and milliseconds) after it ends (fluorescence afterglow period).

The goals of increasing the efficiency of mineral separation and the quality of the concentrating mineral (produced concentrate) are achieved by means of increasing the recovery selectivity of the concentrating mineral.

The recovery selectivity of the concentrating mineral is increased in the known methods both via the selection of a concentration criterion to identify the concentrating mineral among associated minerals in the transported flow of separated matter and by determining its location in the material flow to avoid errors when separating the identified concentrating minerals from the material flow at flow-lump separation, and/or to reduce volume of matter separated from flow at batch separation.

In order to enhance the recovery selectivity of the desired mineral, the known methods of X-ray fluorescence separation use such segregation criterion as various kinetic characteristics of the fluorescence signal recorded both during and after (afterglow period) the action of the excitation radiation on the mineral material.

For example, there is a known method of mineral separation [SU 1 510 185 A1 B03B 13/06, B07C 5/346, 20.08.1995], consisting of excitation of mineral fluorescence, measurement of the initial and current amplitudes of the SC signals during the fluorescence afterglow, and then mineral segregation by criterion of time interval proportional to the time constant of the fluorescence decay.

The drawbacks of this method are as follows; it does not take into account the fluorescence during the excitation pulse, fluorescence intensity of SC is greatly different, for instance, for diamonds and associated minerals. Besides, the use of this method is restricted by the limited amplitude range of the recording instruments. This drawback is essential because the mineral fluorescence intensity may differ by few orders. In view of these faults, concentrating product (concentrate) will get not only the concentrating mineral, but also associated minerals with relatively short afterglow period, but with intensive fluorescence. It leads to essential degradation of selectivity.

Another known separation method of diamond-bearing materials [RU 2235599, C1, B03B 13/06, B07C 5/342, 2004] consists of excitation of fluorescence by pulsed X-ray radiation of sufficient duration to induce SC of fluorescence, determination of total intensity of short and long fluorescence components during X-ray radiation pulse action, determining the intensity of the long fluorescence component with a delay after the end of the X-ray radiation pulse action, determining the segregation criterion value by the ratio of the total intensity of short and long fluorescence components versus the level of long fluorescence component, its comparison with threshold and then separation of concentrating mineral based on comparison results.

The drawback of the described method is the fact that it cannot be applied if the fluorescence signal is out of the linear range (limitation of signal amplitude) of the intensity recording instrument, because in this case the ratio no longer captures the mineral properties. This drawback is essential because the mineral fluorescence intensity in the real ore-dressing machines may differ by few orders of magnitude.

We used another known method for mineral segregation based on their fluorescent properties [RU 2355483, C2, 20.05.2009] as a prototype; it consists of the transportation of separated matter, the irradiation of that matter with a repetition pulse train of excitation irradiation which are long enough to induce SC of fluorescence, recording the intensity of the mineral fluorescence signal during each train period, real-time processing of the recorded signal, determining the segregation criterion value, its comparison with the preset threshold, and the separation of the concentrating mineral from the separated matter flow based on the comparison results. As the segregation criterion parameters, this method uses the combination of three features of the mineral fluorescence signal: the normalized autocorrelation function, the ratio of the total intensity of the FC and SC of the signal recorded during the excitation pulse, and the intensity of the SC of the signal recorded after the preset end time of the excitation pulse, and the fluorescence decay rate. The intensity of the fluorescence signal is recorded in the peak value range that ensures absence of limits for the recorded signal.

The segregation criterion parameters used in this method rather thoroughly consider the kinetic characteristics of fluorescence to identify the concentrating mineral.

The drawbacks of this method are the fact that errors can occur when separating the identified concentrating minerals from the material flow and increase of the volume of the separated material at the flow-lump and batch type separation. These drawbacks are dictated by the fact that the transported flow of segregated matter has concentrating minerals of different types, and their sizes vary within segregated grain-size grade. The fluorescence intensity of such minerals can also differ by 3-4 orders. The difference in mineral sizes causes the expansion of the transported material flow in a plane perpendicular to the plane of the motion from irradiation/recording area to the mineral separation area. The difference in the fluorescence intensity of different minerals results in mineral identification at different stages of excitation. Minerals of high intensity can comply with the segregation criterion virtually under action of the very first excitation radiation pulse; meanwhile, minerals of low intensity can comply with the segregation criterion after action of several radiation pulses. The expansion of transported material flow dictates different conditions of mineral fluorescence excitation. The influence of these factors distorts the kinetic fluorescence characteristics used to determine the segregation criterion parameters, and, therefore, reduces the reliability of mineral identification. These factors especially affect the recovery selectivity of concentrating minerals at the increase of mineral separation throughput performance due to the expansion of the photodetector's view range which also includes induced fluorescence of minerals of high intensity that did not yet enter the exposure area. Such minerals can be identified prior to entering the exposure (irradiation) zone and be missed in separation area; since they do not enter the separation area by time of execution of the separation command received the separator actuator at their identification. In addition, due to view expansion of the photodetector it received fluorescence of minerals of high intensity that already left the exposure area. The recorded intensity of the fluorescence FC here decreases, meantime the intensity of the fluorescence SC decreases much more slowly. Such nature of changes in kinetic characteristics of the recorded fluorescence signal can lead to the erroneous identification of glowing associated mineral as a concentrating one.

DISCLOSURE OF INVENTION

This invention technically results in more selective extraction of concentrating minerals from the segregated material. Another technical result of this invention is the ability to localize the concentrating mineral in the flow of the segregated material.

The technical result will be achieved by the proposed method of X-ray fluorescence separation of minerals, consisting of segregated material flow transportation, irradiation of the material with a repetition pulses train of excitation radiation within the preset section of the material motion path, recording the intensity of the mineral fluorescence signal, real-time processing of the recorded signal to determine the concentration parameters, comparison of the resulting parameters with the preset values and the separation of the concentrating mineral from the transported material flow by the comparison results establishing the threshold of the intensity of the fluorescence signal in some time after the end of the excitation radiation pulse, the process of recording the intensity of the mineral fluorescence signal includes the measuring the intensity of the fluorescence signal at preset time delay after the end of each excitation radiation pulse, storage of derived intensity value for each fluorescence signal provided the recorded signal exceeds the preset threshold, comparison of value measured in the current period with the values derived in previous periods, determining the period when the intensity reached a peak value, and the process of determining the concentration parameter involves the processing of the fluorescence signal, where the value of the measured intensity reached a peak, making a decision on the separation of the concentrating mineral in the event that the concentration parameters are within the preset value range.

Unlike the known method, the proposed method for X-ray fluorescence separation of minerals based on their fluorescent properties establishes intensity thresholds for the fluorescence signal in a preset time delay after the end of the excitation radiation pulse, the process of recording the intensity of the mineral fluorescence signal includes the measurement of the fluorescence signal intensity at preset time delay after the end of each excitation radiation pulse, storage of the derived intensity value for each fluorescence signal provided the recorded signal exceeds the preset threshold, comparison of the value measured in the current period with values derived in previous periods, determination of the period when intensity reached a peak value, and the process of determining the presents or absence of concentrating mineral involves processing the fluorescence signal, where the value of measured intensity reached a peak, making a decision on the separation of the concentrating mineral in the event that the concentration parameters are within the preset value range.

To enhance the quality of the produced mineral by reducing the amount of segregated matter, the duration of the concentrating matter separation operation can be established depending on time point of the action on the segregated matter of the excitation radiation pulse, which measured the value of the fluorescence signal's intensity, reached a peak at the end of that time.

It is also possible to set the delay time prior to the start of the execution of the concentrating mineral separation operation depending on the time point of the action of the excitation radiation pulse on the segregated matter, which measured the value of the intensity of the fluorescence signal, reached a peak at the end of that time.

The combination of features and their relationship with limiting properties in the proposed invention ensures the increased recovery selectivity for the concentrating minerals from the segregated matter in real time, and the possibility of localizing the concentrating mineral in the flow of the segregated matter. The combination of actions proposed herein makes it possible to consider both the kinetic properties of the fluorescence signal of different types and sizes (within each grain size grade) of the concentrating mineral, and trends of these properties depending on the changes in the fluorescence excitation conditions during the mineral transportation through the exposure area. The consideration of dynamic character of fluorescence excitation in different types of concentrating mineral is the determining factor for the combination of characteristic features proposed herein that ensure the increased selective recovery of the concentrating minerals. The combination of features also gives a possibility to improve the technical result on account of localization of concentrating mineral in the flow of segregated matter.

The inventive nature of the proposed solution is also confirmed by the fact that such solutions did not appear for at least last 20 years, in spite of the significance of this problem for the ore-dressing industry. Thus, the proposed engineering solution can truly be considered innovative.

The combination of features and limitations described herein was never referred to in the studies known to the authors.

a—excitation pulses;

b—mineral fluorescence signals recorded during transportation through the irradiation area;

c—mineral fluorescence signals recorded prior to entrance into irradiation area;

d—mineral fluorescence signals recorded after exiting the irradiation area.

Figure 2:
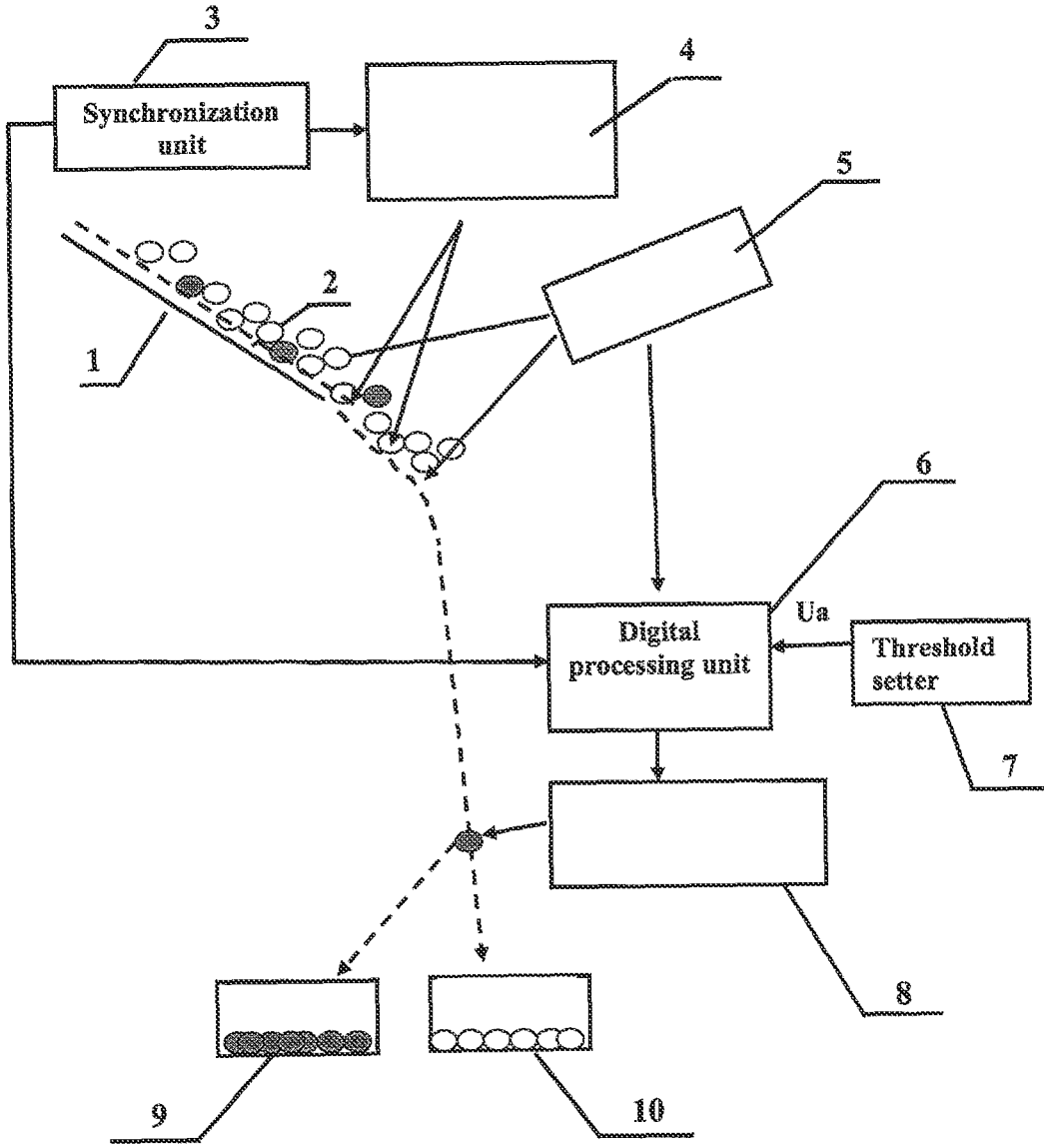

Referring to the FIG. 2 is a schematic illustration of one of option of an embodiment of the present invention.

INDUSTRIAL APPLICABILITY

Figure 1:
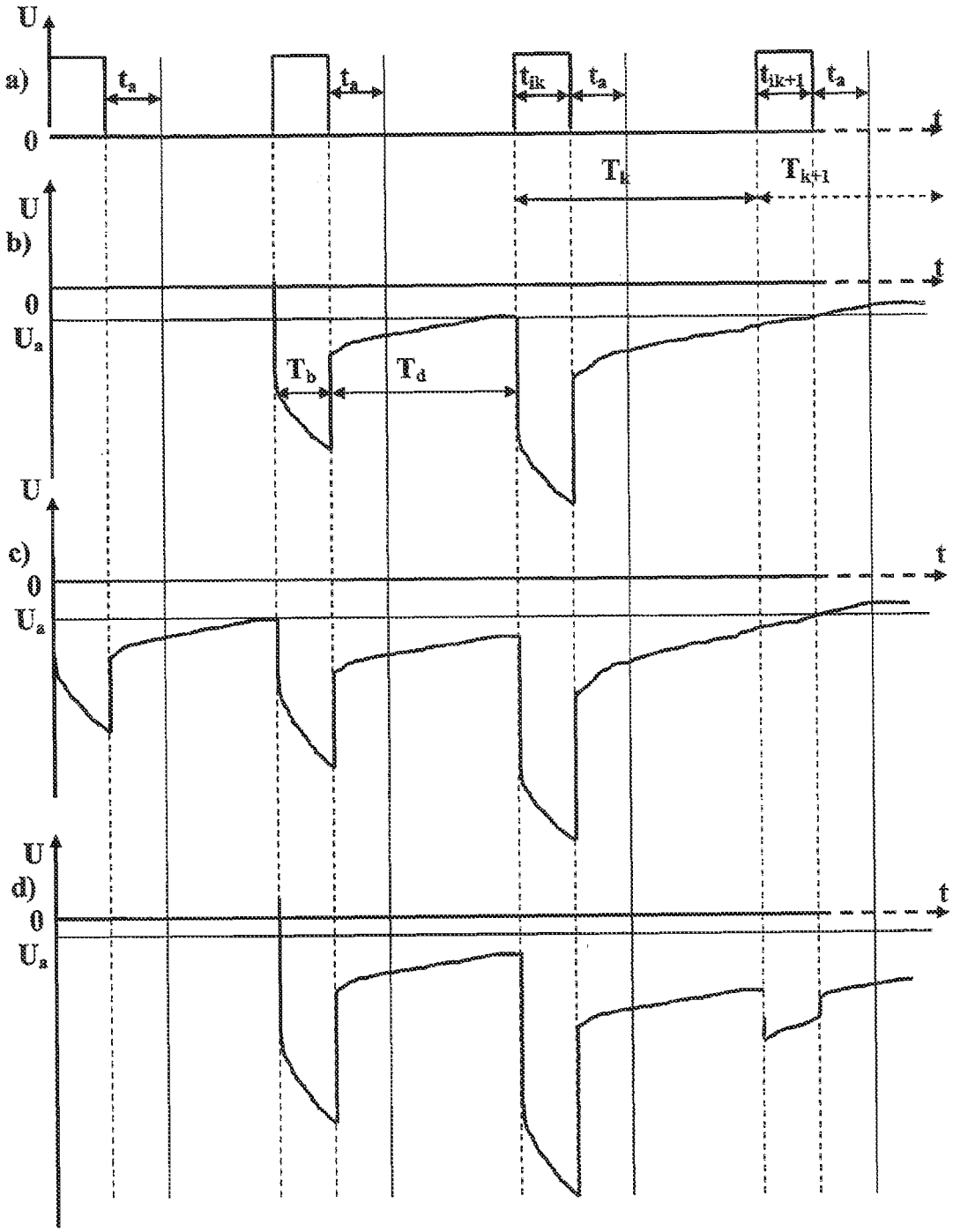
Referring to FIG. 1 one can see illustrated time charts for the recording signals of mineral fluorescence when it is irradiated by the excitation radiation pulses.

The application of the proposed method for the segregation of minerals based on their fluorescent properties is effected as follows; establish the threshold Ua of the intensity of the fluorescence signal U(t) that occurs in preset time $t_a$ after ending of the excitation radiation pulse (FIG. 1 *b-d*). The segregated matter is irradiated with a repetition train of excitation radiation pulses, $t_{ik}$ and a period $T_k$ of excitation radiation (FIG. 1*a*), for example, X-ray radiation. The slow component (SC) of the mineral fluorescence signal U(t) has enough time for deexcitation during the irradiation exposure. Record the signal U=f(t) of mineral fluorescence intensity (FIG. 1 *b-d*) in that energy range, where the fluorescence line characteristic for the concentrating mineral is observed with an intensity adequate for recording. The mineral fluorescence can be recorded from the surface of the separated matter with side directed and/or opposite to the irradiation source. The recorded fluorescence signal U(t) includes both segment $T_b$ of deexcitation fast (FC) and slow (SC) components of the fluorescence signal and segment $T_d$ of the decay of its slow (SC) component (FIG. 1 *b-d*). Fluorescence signal U(t) is recorded upon exposure by every train pulse $t_{ik}$ during the entire period $T_k$ of excitation (FIG. 1*a*). All recorded signals U(t) are subject to real-time processing.

While processing the fluorescence signals U(t), first determine the value of the fluorescence signal $U(t_{ik})$ at the preset point on time axis $t_a$ after the end of the excitation radiation pulse $t_{ik}$ and then compare it with the preset threshold Ua. If the derived value of signal $U(t_{ik})$ is greater than value Ua, it is subject to storing, and then comparison with the value of the signal $U(t_{ik+1})$, recorded in the following excitation radiation pulse $t_{ik+1}$ in case, if $U(t_{ik+1})>Ua$. Determine the excitation period $T_k$ where the value of the signal $U(t_{ik})$ reached its peak U(max) and (in order to get the values of the concentration parameters) further process that signal, where $U(t_{ik})=U(max)$. The derived values of the concentration criterion parameters for signal $U(t_{ik})$ are compared with preset the thresholds of these parameters and the concentrating mineral is separated from the segregated matter provided the concentration criterion conditions are met.

Thus, the proposed method uses the dynamics trends of mineral fluorescence properties depending on changes in fluorescence excitation conditions to improve the selective recovery of the concentrating minerals.

The duration of the concentrating matter separation operation is established depending on the time point of the action of the excitation radiation pulse $t_{ik}$ on the segregated matter after the end of which the measured value of the intensity of the fluorescence signal reached its peak U(max), and the maximum grain size grade of segregated matter, but not less than the excitation period $T_k$. The delay time prior to the start of the separation operation of the concentrating mineral is established depending on the time point of the action of the excitation radiation pulse $t_{ik}$ on the segregation matter, which measured value of the intensity of the fluorescence signal reached its peak at the end of that time. Thus, the proposed method make it possible to automatically change the separation parameters of the concentrating mineral, which also results in improved selective recovery of the concentrating minerals from segregated the matter by reducing the amount of separated matter.

The use of the proposed method is explained in more detail based on example of operation of a device for the industrial application of proposed invention.

The device (FIG. 2) used to apply the proposed method consists of a forwarding mechanism 1 to transport the flow 2 of the segregated matter made as a gravity slide, synchronization unit 3, a pulse excitation radiation source 4, a mineral fluorescence's photodetector 5, a digital processing unit 6 for the fluorescence signal U(t), a threshold setter 7 for the values Ua of the intensity of the fluorescence signal U(t) and thresholds of selected segregation parameters, an actuator 8, receiving bins 9 and 10 respectively for the concentrating mineral and tailings.

The forwarding mechanism 1 transports the flow 2 of segregated matter through exposure-recording zones and cut off zones under required speed (for example, under speed 1-3 m/s). Mechanism 1 can be made, for example, as a gravity slide 1. The synchronization unit 3 provides the required operation sequence of assemblies and units included in the device. Source 4 made an X-ray generator is intended to irradiate the flow 2 of segregated matter via continuous train of the excitation radiation pulse. The photodetector 5 is intended to convert the mineral fluorescence signal U(t) into electrical signal. The digital signal processing unit 6 is intended to process signal from the photodetector 5, to compare the derived values of the parameters of the fluorescence signal U(t) with the preset thresholds and to develop the command for the actuator 8 to separate the concentrating mineral based on the result of the comparison.

Synchronization unit 3 and digital signal processing unit 6 can be combined and made using a personal computer or a microcontroller with built-in multi-channel analog-to-digital converter. The photodetector 5 can be based on photomultiplier tube, such as a FEU-85 or R-6094 (Hamamatsu, Japan). The setter 7 can be made based on a group of switches or a numeric keypad connected to the microcontroller.

The device (FIG. 2) works as follows; prior to feeding the segregating matter, synchronization unit 3 is started and issues the excitation pulses of period $T_k$ and duration $t_{ik}$ sufficient to excite the fluorescence SC to the X-ray generator 4 and digital processing unit 6. The setter 7 enters the numeric values Ua of threshold and values of concentration criterion parameters into unit 6. Then, the slide 1 is supplied with a flow 2 of segregated matter which moves on it under the preset speed determined by the required separation performance. After exiting the slide 1, flow 2 enters irradiation/recording areas where it is exposed to repetitive exposure of X-ray radiation pulses of duration $t_{ik}$ and period $T_k$ (FIG. 1*a*) from source 4. Length of irradiation area in the separation unit is determined by the velocity of the flow 2 and provision of a sufficient amount of fluorescence excitation of the segregated minerals. Normally, in order to meet the conditions of fluorescence excitation, segregated mineral as it moves through the excitation area shall be exposed to the action of a minimum of 3 radiation pulses $t_{ik}$ from generator 4. In device with higher separation performance the flow 2 of segregated matter moves along slide 1 with rather high velocity and when exiting slide 1 it expands in plane perpendicular to the movement from irradiation/recording area to area of separation of concentrating minerals. Flow 1 expansion takes effect when separating material of higher grain size, for example (−50+20) mm. Thereby, photodetector 5 in the separation unit shall be located rather far from the flow 2 motion path, which leads to significant expansion of its view. Irradiation areas in such separation unit fully matches with recording area, but length of the recording area towards the flow 2 motion is greater than length of the irradiation area.

Some minerals in segregated matter fluorescence under effect of X-ray radiation created by generator 4. Fluorescence signal goes to the photodetector 5, which converts it into an electrical signal that is delivered to the processing unit 6. By means of the synchronization unit 3, the processing unit 6 records the signal from the photodetector 5 in synchronicity with current excitation pulse $t_{ik}$ during entire period $T_k$ in real time; determines the values $U(t_{ik})$ of the fluorescence signal in preset point of time $t_a$ after the end of the excitation pulse, compares the derived value $U(t_{ik})$ with the threshold Ua of the signal and stores it, if $U(t_{ik})>Ua$. Value $U(t_{ik+1})$ of the fluorescence signal determined under every following excitation pulse $t_{(ik+1)}$ is compared by unit 6 with the previous value $U(t_{ik})$ until the point when the value $U(t_{ik+1})$ of the recorded fluorescence signal is less than the previous value $U(t_{ik})$. In the same period $T_{k+1}$ of pulse train, where $U(t_{ik+1})<U(t_{ik})$, unit 6 processes the fluorescence signal $U(t_{ik})$ recorded in period $T_k$, where the signal value $U(t_{ik})=U(max)$. When processing the signal $U(t_{ik})=U(max)$, unit 6 determines the values of the concentration parameters, compares them with the appropriate thresholds and makes a decision on mineral separation from flow 2, if the derived values of the parameters meet the present segregation conditions. A signal for executing separation is delivered from unit 6 to the actuator 8, which directs the concentrating mineral from flow 2 into the receiving bin 9 for concentrating products; meanwhile the remaining matter in flow 2, not to change the direction of its motion, enters the bin for tailings 10.

PREFERRED EMBODIMENT

In the proposed method for X-ray separation of fluorescent minerals, the concentration parameters are determined using that signal where the mineral fluorescence excitation reached its peak completeness, and, therefore, all inherent characteristic features of the fluorescence process for this mineral are most fully presented. This ensures that the concentration parameters that are then fixed will be accurate and improves the selectivity of the recovery of concentrating minerals. Indeed, since the length of the irradiation area is selected based on full fluorescence excitation of all the concentrating minerals, regardless of their inherent intensity, then in this particular area, the photodetector 5 records the signal U(max) with maximum intensity. The synchronization unit 3 provides link between period $T_k$ of excitation pulse train $t_{ik}$ and signal with recorded intensity $U(t_{ik})=U(max)$. This makes it possible to establish the duration of the concentrating matter separation operation depending on the time point of action of this particular excitation radiation pulse on the segregated matter, and the delay time prior to the beginning of the concentrating mineral separation operation. Correlation of the concentrating mineral separation process (time and duration of the response of actuator 8) with the certain excitation pulse make it possible to reduce the amount of matter separated from flow 2, and, correspondingly, additionally improve the recovery selectivity of concentrating mineral and quality of concentrated product.

Method of X-ray fluorescence mineral separation by fluorescent properties proposed herein is in compliance with the "industrial applicability" criterion and can be used, for example, on the basis of a LS-20-05-2N TU—4276-054-00227703-2003 commercially produced separator.

Thus, the proposed method of X-ray fluorescence mineral separation ensures the achievement of technical results; improving the selective recovery of concentrating minerals from segregated matter. Increased recovery selectivity of concentrating minerals significantly improved the quality of the concentrate produced, which, it turn, improves the viability and economic efficiency of the entire beneficiation process.

The invention claimed is:

1. A method for separating minerals using X-ray fluorescence, comprising the steps of:

(a) irradiating material in a segregated material flow moving along a path with a plurality of pulses of excitation radiation within a preset section of the path of, (b) recording a signal representing an intensity of the mineral fluorescence, wherein the recording of the intensity includes the measurement of the intensity of the fluorescence signal during a preset time after the end of each excitation radiation pulse, (c) establishing a threshold of fluorescence signal intensity in a preset time after the end of the excitation radiation pulses, (d) storing a derived intensity value for each fluorescence signal provided by the signal that exceeds the threshold, (e) comparing of the value measured in a current time period with the values derived in previous time periods, (f) determining of a time period when the derived intensity value reaches a peak value (g) determining a plurality of concentration parameters by processing of the fluorescence signal, wherein the value of the measured intensity reached a peak therefor, (h) comparing the plurality of concentration parameters with a preset value range and separating a concentration of the minerals from the segregated material flow when the concentration parameters are within the preset value range.

2. The method of claim 1, further comprising the step of establishing a duration of the execution of concentrating mineral separation operation depending on time period of the action of the excitation radiation pulse on the segregated matter, the measured fluorescence signal intensity of which reached a peak value therefor.

3. The method of claim 1, further comprising the step of establishing a delay time prior to the start of the execution of the concentrating mineral separation operation depending on the time period of the action of the excitation radiation pulse on the segregated matter, the measured value of which the intensity of the fluorescence signal reached a peak therefor.

* * * * *